United States Patent [19]

Pons

[11] Patent Number: 4,604,071

[45] Date of Patent: Aug. 5, 1986

[54] PROCESS FOR ALIGNING AND CENTERING AN ASSEMBLY OF ELECTRON-GUNS ON A COLOR TELEVISION TUBE AND DEVICE FOR CARRYING OUT THE PROCESS

[75] Inventor: Claude Pons, Grottaferrata, Italy

[73] Assignee: Videocolor, Montrouge, France

[21] Appl. No.: 622,331

[22] Filed: Jun. 19, 1984

[30] Foreign Application Priority Data

Jun. 21, 1983 [FR] France ..... 83 10240

[51] Int. Cl.[4] ..... H01J 9/42

[52] U.S. Cl. ..... 445/4; 445/64

[58] Field of Search ..... 445/4, 64

[56] References Cited

U.S. PATENT DOCUMENTS

| | | | |
|---|---|---|---|
| 2,154,500 | 4/1939 | Elmendorf | 445/64 |
| 3,962,764 | 6/1976 | Stewart et al. | 445/4 |
| 3,962,765 | 6/1976 | Stachel et al. | 445/4 |
| 4,148,117 | 4/1979 | Bracke et al. | 445/4 |

FOREIGN PATENT DOCUMENTS

| | | | |
|---|---|---|---|
| 2257075 | 8/1975 | France . | |
| 2341937 | 9/1977 | France . | |
| 114254 | 9/1981 | Japan | 445/4 |
| 48206 | 6/1982 | Japan | 445/64 |

*Primary Examiner*—Kenneth J. Ramsey

*Attorney, Agent, or Firm*—Pollock, Vande Sande & Priddy

[57] ABSTRACT

The present invention concerns a process and a device for aligning and centering an assembly of electron-guns on a color television tube during the manufacturing process. To do this, the image of the markings of the assembly of electron-guns is formed on analyzers, each comprising a charge-coupled photosensitive strip. The alignment is observed when the comparison signal is lower than a predetermined value. Instead of markings, the image of the sections of the assembly of guns can be used as the section comprising the grid G4 in the cup.

20 Claims, 7 Drawing Figures

PROCESS FOR ALIGNING AND CENTERING AN ASSEMBLY OF ELECTRON-GUNS ON A COLOR TELEVISION TUBE AND DEVICE FOR CARRYING OUT THE PROCESS

BACKGROUND OF THE INVENTION

1. Field of the Invention

The present invention concerns a process for aligning and centering an assembly of electron-guns on a color television tube. It also concerns a device to carry out the process according to the invention.

A classic color television tube comprises a glass shell or envelope of which the enlarged end supports a screen. It also comprises a neck facing the screen that supports an assembly of electron-guns. This assembly is constituted by a disposition of thermoelectronic cathodes and electrodes, for example, an in line or deltawise disposition. It constitutes a mechanical entity that must be inserted on the tube, by its neck, with a maximal precision with respect to both rotation and position relative to the central axis of the tube. It thus concerns the insertion of the assembly of guns with a positioning error as low as possible.

2. Description of the Prior Art

Different means are known in the prior art for measuring the placing error, prior to sealing of the assembly of guns to the tube. Among those are mechanical devices of the so called feelers type, image superimposition devices and devices using the intensity variation of a transmitted or reflected luminous beam which are especially known. A description of these devices will be found in French patent published under No. 2 341 937. The present invention proposes a simple means, relatively insensitive to errors, for supplying position data able to be immediately used by an automatic adjustment system. Indeed, the alignment processes using optical intensity measurements are affected by imprecisions due to noise and to the difficulty of appreciating intensity maximums.

With this aim, the present invention concerns a process for aligning and centering an assembly of electron-guns on a color television tube. In such a process, the angle between a first direction corresponding to the direction of the assembly of guns and a second reference direction is cancelled or rendered void. In the process according to the invention, beam is formed on at least one optical analyzer a contrasted image with sharp edges of a section of the assembly of guns. The measurement of the position of the image on the analyzer is a measurement of the placing error that is cancelled by the displacement of the assembly of guns.

The present invention also concerns a device for carrying out the process described herein above. The device according to the invention comprises at least one optical analyzer along a reference direction mounted on a support, the analyzer supplying a measurement of the placing error that is cancelled by the displacement of the assembly of guns to be mounted on the neck of a television tube.

One advantage of the present invention is to allow an easy adaptation to assemblies of guns of different types. In particular, it allows the mounting of guns that bear optical markings, reflecting patches or wallholes.

Another advantage of the invention is to supply distinct data for the centering and aligning. Indeed, it will be observed that if the axis of the assembly of guns does not coincide, i.e. is non-centered with the axis of the tube, it will be observed on two optical analyzers, that a dissymmetry of images as well as a shift due to an alignment defect representing an angular shift of the assembly of guns about its axis occur.

BRIEF DESCRIPTION OF THE DRAWINGS

The present invention will be better understood by reading through the following description, given with reference to the annexed drawings in which.

DETAILED DESCRIPTION OF THE DRAWINGS

Figure 1:
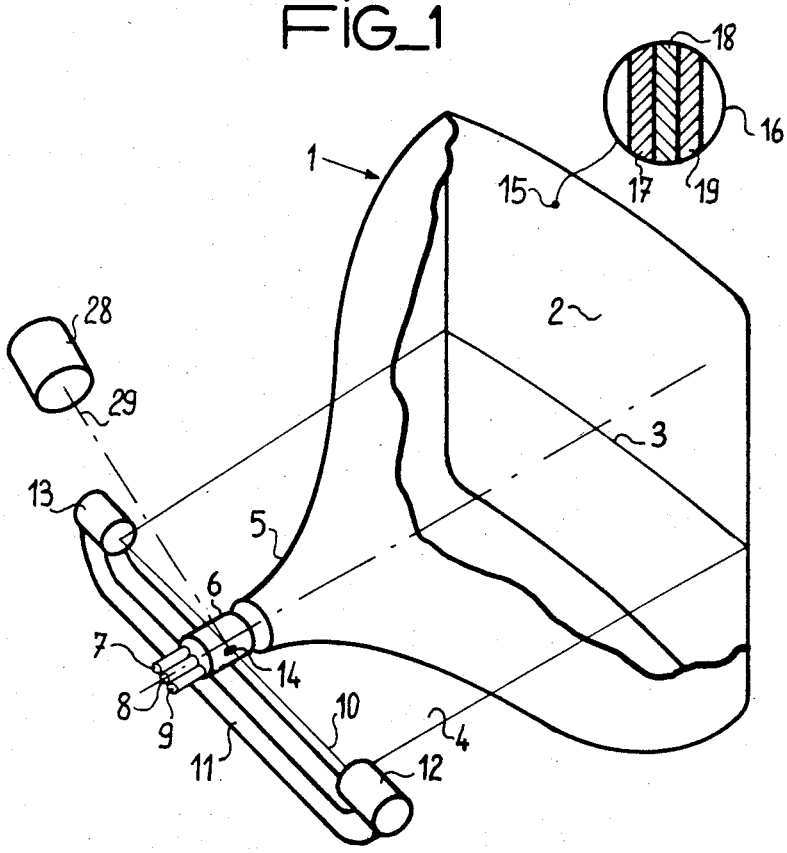
FIG. 1 is a schematic representation of a device carrying out the process according to the invention.

FIG. 1 represents a schematic representation of a device for operating the process according to the invention. The image formation tube 1 represented in this figure is, for example, a color television tube. It comprises, among others, a glass envelope or shell of which the large face is provided with an electro-luminescent screen 2. Opposite this screen, the tube 1 comprises a neck 5 intended to carry the electromagnetic deviator and the assembly of guns 6. The assembly of guns 6 is intended to be adapted to the neck 5 along the length of the axis 8. Once installed in a suitable position, the assembly 6 is welded to the neck 5. The assembly of guns comprises a body 6 and three guns 7, 8 and 9, each reserved to one of the three primary colors of the trichromatic television. In the embodiment represented in FIG. 1, these three guns are aligned in a plane of which the outline is indicated by reference 4 on FIG. 1. The screen 2 has a generally bulging shape. Each luminophorous element 15 is intended to be struck by the three electrons beams issuing from guns 7–9. Through the use of a magnifying glass, the structure of a particular triad of luminophorous elements is magnified. It is constituted by a portion of three suitably treated phosphor material bands. Each of these bands 17, 18 and 19 is reserved to a particular electron-gun corresponding to the color that it is desired to emit. The direction of these bands is perpendicular to the plane of the three guns once the assembly 6 is installed and positioned normally. This disposition ensures an appropriate convergence during the installation of the deviators on the neck 5, if the plane 4 is perpendicular to the direction of the bands 17 to 19.

The problem that has to be overcome is knowing exactly the position of the plane 4 of the three guns 7 to 9 in such a way as to bring it into a reference position where it will be perpendicular to the direction of the bands 17 to 19. This reference position is constituted by an axis 10 called reference direction. An alignment device according to the invention comprises two optical analyzers 12 and 13 mounted on a support 11 and aligned on this axis 10. The two analyzers are mounted symmetrically on either side of the central axis 8 of the tube. A lighting 28 emits a luminous beam 29 on a reference element of the assembly of guns 6. The optical analyzers 12 and 13 are connected to a computer that allows actuation servo-systems (non represented in the figure) that cause to rotate the assembly of guns 6–9 in such a way that it is presented in the neck 5 according to the direction foreseen.

Figure 2:
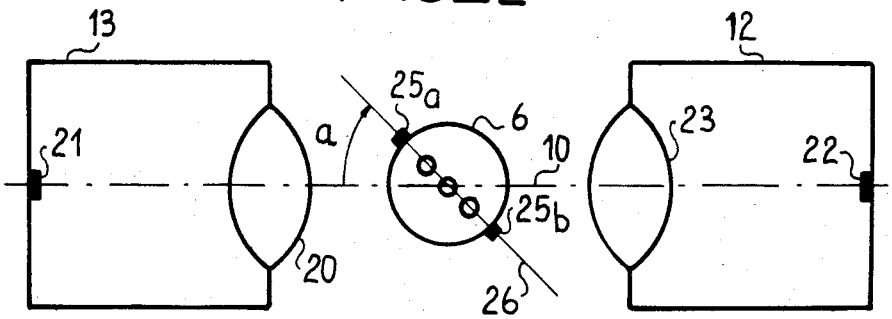
FIG. 2 is an adjustment device of an assembly of guns according to the invention.

FIG. 2 represents a diagram of such a device intended to show a placing error in alignment. The two analyzers 12 and 13 are situated facing each other along an axis 10. The assembly of guns 6 presents a placing error so that the symmetry plane of the guns forms an angle a with the direction 10. The symmetry plane of the guns is represented in FIG. 2 along a first direction 26. It is thus necessary to measure angle a which is formed by this first direction 26 with the second reference direction 10. Each analyzer comprises in a housing an objective lens 20 or 23 intended to form a contrasted image with sharp edges on an electro-optical retina 21 or 22. This retina can be constituted by a multi-element photosensitive linear strip, for example, a charge-coupled device (CCD). In one embodiment, the component TH 7802 is used. The linear strips are, for enhanced simplicity and improvement of the measurement resolution, disposed facing opposite, perpendicular to the reference direction 10.

Figure 3:
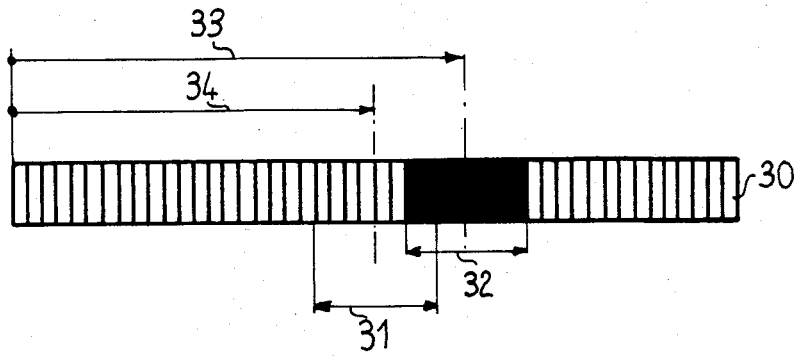
FIG. 3 is a detail of the operation of an analyzer according to the invention.

FIG. 3 represents the operation according to the invention of a charge-coupled strip. The strip 30 comprises a plurality of distinct photosensitive elements. An electronic device integrated to the strip senses easily the lighting intensity and the exact position of each of the excited photo-elements. This figure represents as a shaded area 32 the image formed on the strip 30 by an objective lens like the objective lens 20 of the analyzer 13. In an embodiment according to the invention represented, more specifically in FIGS. 1 and 2, the optical marking image 25*a* or 25*b* is formed, also represented by reference 14 in FIG. 1. These markings can be constituted by reflecting or opaque patches or also by rectangular holes provided in the body 6 of the assembly of guns. Reference 31 (FIG. 3) corresponds to the position that the image of the optical marking must assume once the assembly of guns is aligned. By appropriate electronic means the first photosensitive element excited and the last photosensitive element excited in the image 32 can thus be known. By simple calculation of the half-total of their rank numbers, the position of the center of the image is thus known. In bringing this value to the desired value 34 of the position of the image of the marking corresponding to the alignment, such a disposition effectively allows to effect an alignment with a single optical analyzer.

Figure 4:
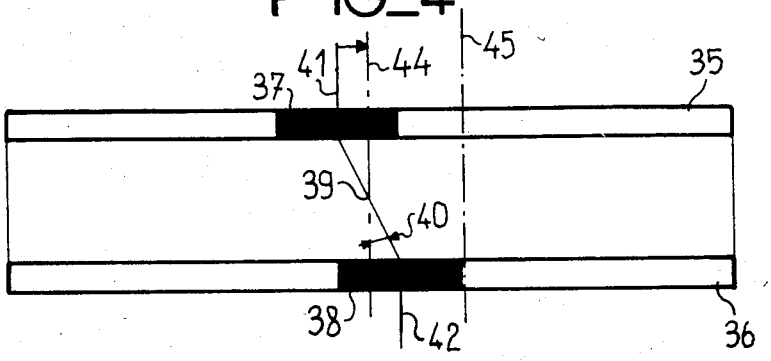
FIG. 4 is another way of operation according to a variant of the invention.

FIG. 4 represents another embodiment according to which two charge-coupled photosensitive strips are used. They are linear and disposed perpendicularly to the reference direction 10 and to the central axis of the tube. These strips 35 and 36 receive the images 37 and 38. The pivoting center of the assembly of guns is the point 39. It thus involves cancelling the angle indicated by the marking 40. When the direction containing the centers 41 and 42, or positions of the images 37 and 38, and the pivoting center 39 of the assembly of guns is perpendicular to the parallel directions of the linear strips, the alignment is realized. This alignment condition is obtained by rendering equal the values 41 and 42 obtained respectively by the half-total of the positions of the first and the last photosensitive elements activated by the image on each of the strips 35 or 36.

In FIG. 4, the direction 45 corresponds to a nil error of placing in alignment and in centering. Indeed, once the assembly of guns is aligned on the direction 44, it is certain that the plane of the three guns contains the reference direction 10 of FIG. 1. But it is possible that a centering error remains. It is therefore measured by the deviation between both directions 44 and 45. By a translation in the direction perpendicular to the reference direction 10, the centering error of placing is cancelled.

Other dispositions are possible, especially that of positioning the three analyzers at 120° from one another about the axis of the tube in order to bring about complete centering correction.

Figure 5:
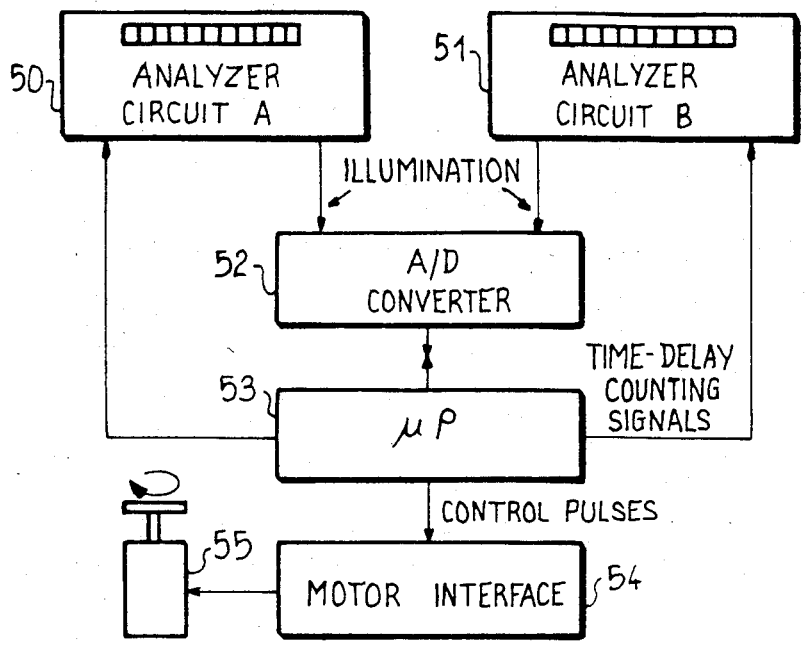
FIG. 5 is an automatic alignment circuit to be used according to the invention.

FIG. 5 represents a processor permitting an automatic monitoring of aligned mounting. The drawing does not represent the mechanical parts allowing the handling and maintenance of the assembly of guns and of the tube. The analyzers are connected to circuits 50 and 51 called analyzer circuit A and analyzer circuit B. Their lighting outputs are connected to a bi-path analog-to-digital converter 52, the output of which is a bus connected to a microprocessor 53 provided with appropriate memory means. The microprocessor 53 generates, on the one hand, the time-delay counting signals of the cells allowing the operation of the charge-coupled strips of the analyzers A and B and, on the other hand, the control pulses of a motor interface 54. The control pulses are controlled by the difference between a preregistered value in the memory means of a microprocessor and the half-total of the rank numbers of the first and last photosensitive elements excited by the image on the strip of each analyzer or, if the centering of the assembly 6–9 is effected, by the difference between the above-mentioned half-totals on each of the two analyzers 12 and 13 disposed symmetrically on either side of the assembly 6. This motor interface delivers, for example, an electric voltage to a motor 55 allowing to convert the variations represented in FIG. 4 between the two images on the rotating analyzers A and B of the motor 55 allowing the obtaining of the alignment desired.

Figure 6:
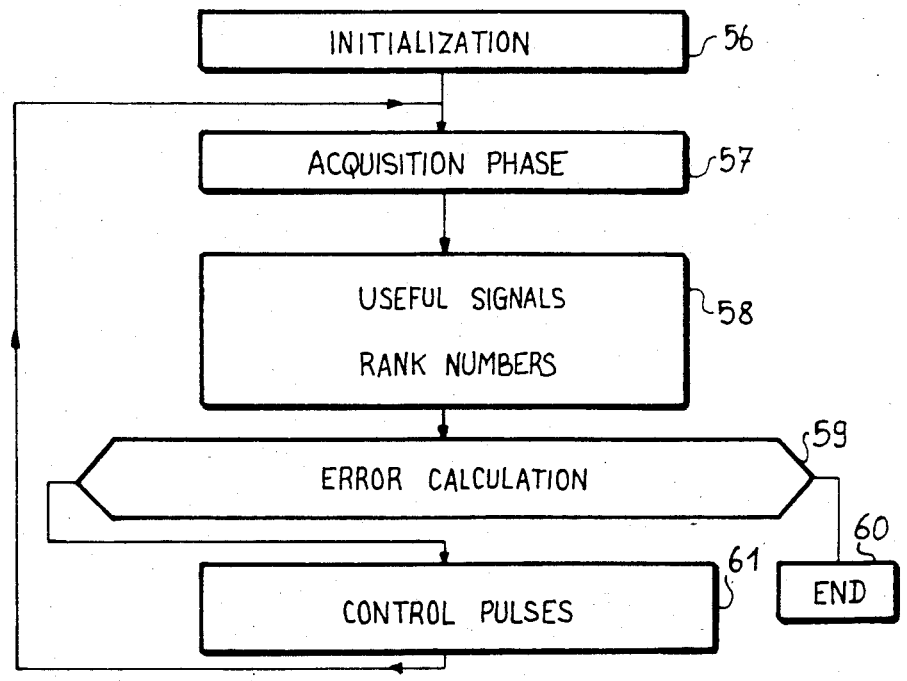
FIG. 6 is a schematic algorithm of the data means used to operate the invention.

FIG. 6 represents an operation algorithm of the circuit shown in FIG. 5. Such an algorithm starts by initialization operations 56 prior to entering in the servo-loop constituted by an acquisition phase 57 of the signals of analyzer circuits A and B. Thereafter, there are identified in 58 the useful signals for the calculation of the values desired. Such a calculation is possible by counting or measuring the rank numbers of the edges of the image of each of the markings deposited on the assembly of guns. These different data are used in 59 to calculate the error, i.e. the angle a of FIG. 2 that it is necessary to cancel to obtain the alignment, for example, by using the half-total of the rank numbers of the images deposited in the markings. If the error is smaller than a certain limit called resolution limit or alignment error, the computer connects on the routine of the end of program 60. If not, it is returned to the motor control impulses generation 61 so as to cause to progress the error towards its cancellation. Then the signals are returned to acquisition 57.

Figure 7:
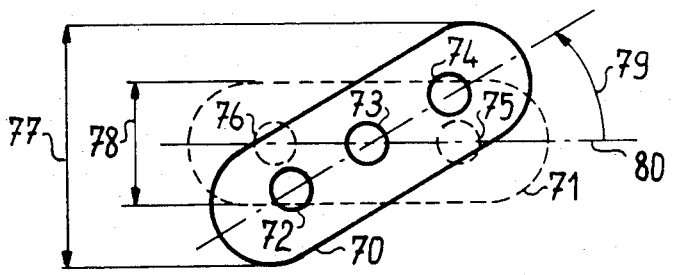
FIG. 7 is a schematic representation of another embodiment according to the invention.

FIG. 7 represents another embodiment according to the invention in which a particular form of the assembly of guns is used to realize alignment.

Indeed, the assembly of guns is often constituted by a series of cups called focussing electrodes or grids realized in brilliant metallic material that can be suitable for forming images on the charge-coupled strips. In certain configurations, in particular, one of the grids has the form of a cylinder of which the right section is constituted by two half-cylinders connected by flat portions. In alignment position the projection on a plane perpendicular to the axis 80 represented in FIG. 7 is of minimum dimension. In such an embodiment of the process according to the invention, an image 77 is thus realized where the current position of the assembly of guns presents an angle of deviation 79. This image 77 must be reduced in dimensions. By rotation this value is brought to a value 78 corresponding to the alignment position 80. The operation can also comprise the calculation of the center of the image in such a way as to center the axis of the central beam carried by the gun 73, especially by using two optical analyzers, as seen herein above.

The use in each of these embodiments according to the invention of two analyzers allows simple calibration. The measuring device can, indeed, be subject to deformations and incorrect alignments of the analyzers. For this reason, it is necessary to realize a calibration of the two analyzers by determining the alignment error D. The alignment error D can be measured by the rank-number of the photosensitive element that corresponds to the photosensitive element rank-number 1 (the first) on the reference direction 10. Thereafter, this value D must be added to each of the values measured on one of the two analyzers to obtain the correct value.

Other variants are possible which would not use a linear detection but a matricial detection; in such a way as to also realize simultaneously an alignment of the gun in the vertical direction, also called north-south direction on the screen of FIG. 1. It is also possible, without departing from the field of the invention to double the measuring device of FIG. 1 in order to obtain such an alignment in rotation about axis 8 and about axis 10 of the assembly of guns.

The embodiments described up to now concern applications where the assembly of guns 6 to 9 is brought without any possible error along the length of the central axis 8 of the tube 1. The invention also allows to realize servo-correction of the centering error of the assembly of guns. This is especially possible due to the great resolution of the device when the photosensitive strips comprise 256 and even 1024 active elements. In one embodiment where a single image of a section of the assembly of guns is used (cf. FIG. 7) two values are available. The first 77 is the dimension of the image. It has been seen that to obtain correct alignment it is necessary to bring this dimension to a predetermined value, for example minimal in the case of FIG. 3. Furthermore, to effect centering, it is necessary to measure the value of the position of the center of this image. In bringing by translation to the assembly of guns this value to a predetermined value, an appropriate centering is also obtained by using the same means as those described in FIGS. 5 and 6. This process is also suitable for embodiments using two optical analyzers, with or without optical markings.

What is claimed is:

1. In a combination color television tube having an electro-luminescent screen and a neck extending therefrom, contiguous luminophorous element bands formed vertically on the inner surface of the electro-luminescent screen, a gun assembly having three guns placed to the rear of the neck and along the longitudinal axis from the center of the screen for striking the luminophorous element bands with three beams, the gun assembly further including a marker means, an apparatus for aligning and centering the gun assembly to the luminophorous element bands for canceling a positioning error formed therebetween, the apparatus comprising:

two optical means placed on opposing sides of the gun assembly for forming therebetween a symmetry plane in perpendicular relationship to the vertical luminophorous element bands, wherein the perpendicular relationship between the symmetry plane and the vertical luminophorous element bands defines a reference marker representative of an alignment value for a proper convergence of the three beams, the symmetry plane intersecting the gun assembly;

a light means located near the gun assembly for projecting a luminous beam onto the marker means of the gun assembly, thereby establishing an angle between the symmetry plane and the luminous beam, the angle being representative of the positioning error;

analyzer means located along the symmetry plane for sensing the marker means and for storing an image of the sensed marker means, the sensed image being contrastee with the reference marker, the distance between the center of the sensed image and the center of the reference marker being representative of the positioning error angle; and positioning means working cooperatively with the analyzer means for maneuvering the gun assembly in response to the distance between the sensed image and the reference marker in a real time basis, thereby canceling the positioning error angle between the symmetry plane and the luminous beam;

wherein the proper convergence of the three beams from the gun assembly to the luminophorous element bands is ensured.

2. Apparatus according to claim 1, wherein the analyzer means comprises:

an optical lens for sensing the image of the marker means, the optical analyzer means further comprising a photosensitive electronic device aligned along the length of a direction perpendicular to the luminophorous bands for storing the sensed image.

3. Apparatus according to claim 2, wherein the photosensitive electronic device comprises a charge-coupled photosensitive strip, including a plurality of photosensitive elements, each of the elements being represented by a corresponding rank number; and wherein the charge-coupled photosensitive strip has thereon selective excited photosensitive elements for representing the sensed image, the value of the sensed image being represented by the half-total of the rank numbers of excited first and last photosensitive elements.

4. Apparatus according to claim 3, wherein the light means comprises:

a projector for lighting the marker means of the gun assembly to produce on the analyzer means a sharply contrasting image of the marker means.

5. Apparatus according to claim 4, wherein the marker means comprises light-reflecting patches.

6. Apparatus according to claim 4, wherein the marker means comprises:

openings disposed on the body of the gun assembly at the level of the focussing electrodes of the guns.

7. Apparatus according to claim 5 or 6, wherein the positioning means comprises:

a motor and grasping means for maneuvering the gun assembly.

8. In a combination color television tube having an electro-luminescent screen and a neck extending therefrom, contiguous luminophorous element bands formed vertically on the inner surface of the electro-luminescent screen, a gun assembly having three guns placed to the rear of the neck and along the longitudinal axis from the center of the screen for striking the luminophorous element bands with three beams, the gun assembly further including a marker means, an apparatus for aligning and centering the gun assembly to the luminophorous element bands for cancelling a positioning error formed therebetween, the apparatus comprising:

two optical means placed on opposing sides of the gun assembly for forming therebetween a symmetry plane in perpendicular relationship to the vertical luminophorous element bands, wherein the perpendicular relationship between the symmetry plane and the vertical luminophorous element bands defines a reference marker representative of an alignment value for a proper convergence of the three beams, the symmetry plane intersecting the gun assembly;

a light means located near the gun assembly for projecting a luminous beam onto the marker means of the gun assembly, thereby establishing an angle between the symmetry plane and the luminous beam, the angle being representative of the positioning error;

two opposed analyzer means positioned co-planarly along the symmetry plane and sandwiching the gun assembly for sensing two corresponding markers of the marker means placed on the gun assembly, each of the two analyzer means further storing the sensed image of the corresponding marker, the sensed images being contrasted with each other and the distance between the centers of the respective sensed images being representative of the positioning error angle;

positioning means working cooperatively with the analyzer means for maneuvering the gun assembly in response to the distance between the centers of the sensed images in a real-time basis, thereby canceling the positioning error angle between the symmetry plane and the luminous beam;

wherein the proper convergence of the three beams from the gun assembly to the luminophorous element bands is ensured.

9. Apparatus according to claim 8, wherein each of the two opposed analyzer means comprises:

an optical lens for sensing the image of the corresponding marker, each of the analyzer means further comprising a photosensitive electronic device including several active elements aligned along the length of a direction perpendicular to the luminophorous element bands for storing the corresponding sensed image.

10. Apparatus according to claim 9, wherein the photosensitive electronic device comprises a charge-coupled photosensitive strip, including a plurality of photosensitive elements, each of the elements being represented by a corresponding rank number; and wherein the charge-coupled photosensitive strip has thereon selective excited photosensitive elements for representing the sensed image, the value of the sensed image being represented by the half-total of the rank numbers of excited first and last photosensitive elements.

11. Apparatus according to claim 10, wherein the light means comprises:

a projector for lighting the marker means of the gun assembly to produce on the analyzer means a sharply contrasting image of the marker means.

12. Apparatus according to claim 11, wherein the marker means comprises light-reflecting patches.

13. Apparatus according to claim 11, wherein the marker means comprises:

openings disposed on the body of the gun assembly at the level of the focussing electrodes of the guns.

14. Apparatus according to claim 12 or 13, wherein the positioning means comprises:

a motor and grasping means for maneuvering the gun assembly.

15. In a combination color television tube having an electro-luminescent screen and a neck extending therefrom, contiguous luminophorous element bands formed vertically on the inner surface of the electro-luminescent screen, a gun assembly having three guns placed to the rear of the neck and along the longitudinal axis from the center of the screen for striking the luminophorous element bands with three beams, the gun assembly further including marker means, a method for aligning and centering the gun assembly to the luminophorous element bands for canceling a positioning error formed therebetween, the method comprising:

placing two optical means on opposing sides of the gun assembly for forming a symmetry plane perpendicular to the bands and itnersecting the gun assembly;

defining from the perpendicular relationship between the symmetry plane and the bands a reference marker corresponding to an alignment value for proper convergence of the three beams;

projecting a luminous beam onto the marker means of the gun assembly for establishing an angle between the luminous beam and the symmetry plane, the angle being representative of the positioning error;

sensing, via analyzer means located along the symmetry plane, at least one image from the marker means;

contrasting the at least one of the images with the alignment value for determining a positioning error value; and positioning the gun assembly in response to the positioning error value for canceling the positioning error angle between the symmetry plane and the luminous beam on a real-time basis.

16. Method according to claim 15, wherein the contrasting step further comprises:

equating the distance between the center of the at least one of the sensed images and the center of the reference marker with the positioning error value.

17. Method according to claim 15, wherein the sensing steps further comprises:

sensing two images from two markers of the marker means.

18. Method according to claim 17, wherein the contrasting step further comprises:

comparing the centers of the two sensed images to each other; and equating the distance between the two centers with the alignment value.

19. Method according to claim 18, wherein the positioning step further comprises:

rotating the gun assembly so as to bring into coincidence the centers of the two sensed images.

20. Method according to claim 18, wherein the positioning step further comprises:

maneuvering the gun assembly for bringing the centers of the two sensed images to coincide with a predetermined value.

* * * * *